United States Patent [19]

Fraher

[11] Patent Number: 4,943,002

[45] Date of Patent: Jul. 24, 1990

[54] ASH CONTAINER

[76] Inventor: Daniel Fraher, P.O. Box 141, Aroma Park, Ill. 60910

[21] Appl. No.: 353,885

[22] Filed: May 18, 1989

[51] Int. Cl.[5] ..... B65D 91/00

[52] U.S. Cl. ..... 232/43.1; 220/1 T

[58] Field of Search ..... 232/43.1, 44; 220/1 T; 110/165 R

[56] References Cited

U.S. PATENT DOCUMENTS

| | | | |
|---|---|---|---|
| 4,363,417 | 12/1982 | Rhoades et al. | 220/1 T |
| 4,387,847 | 6/1983 | Downey | 232/43.1 |
| 4,406,395 | 9/1983 | Scoggins | 232/43.1 |
| 4,872,582 | 10/1989 | Sipple | 220/1 T |

*Primary Examiner*—Robert W. Gibson, Jr.
*Attorney, Agent, or Firm*—Leydig, Voit & Mayer

[57] ABSTRACT

An ash container adapted for relatively easy and substantially dust-free containment of ash from fireplaces and wood-burning stoves. The container includes a receptacle having a bottom wall and a side wall defining a top opening, a removeable cover for closing the open top of the receptacle, and an entrance collar extending outwardly from one side of the side wall intermediate the bottom wall and the top of the receptacle for defining an unencumbered entrance opening to the receptacle. The bottom wall and a lower uninterrupted portion of the side wall define an ash accumulation zone below the entrance opening for containing ash deposited into the receptacle through the entrance opening, and the cover and an upper uninterrupted portion of the side wall define a dust reflection and redirection zone above the entrance opening for confining and redirecting downwardly into the accumulation zone dust from ash deposited into the receptacle through the entrance opening.

8 Claims, 1 Drawing Sheet

ASH CONTAINER

DESCRIPTION OF THE INVENTION

The present invention relates to dustless containers for ashes, such as ashes from fireplaces and woodburning stoves.

In recent years, due to the high cost of modern energy production, increasing numbers of homeowners have turned to woodburning stoves and fireplaces for cooking and heating purposes. Modern homes are now being constructed with various types of woodburning devices which require periodic cleaning and ash removal. This chore often is messy. Due to the lightness of the wood stove and fireplace ash, it frequently proves difficult to shovel the ash into a conventional ash can without the escape of rising dust and soiling of the surrounding areas.

Heretofore, ash containers have been proposed with various types of closeable entry openings, such as pivotable or swinging doors, for the purpose of preventing dust and ashes from escaping into the environment of the room after it is deposited into the container. These prior devices often have been complicated, unsightly, and cumbersome to use, with the closeable doors of such devices frequently interfering with easy access to the container and contributing to ash and dust being dropped outside the container.

It is the object of the present invention to provide a relatively simple and easy to use, substantially dust free ash container.

Another object is to provide an ash container as characterized above which permits unencumbered access to the container when depositing ash from a fireplace or woodburning stove into the container and which tends to prevent the escape of airborne dust within the container to the outside environment.

A further object is to provide a dustless ash container of the above kind which is free of swinging or closeable doors that must be manipulated when shoveling or otherwise depositing ash into the container.

Yet another object is to provide a dustless container of the foregoing type which has an esthetically pleasing appearance that enables it to be attractively stored in the home environment in close relation to the fireplace or woodburning stove for easy access.

Still a further object is to provide such an ash container which is relatively simple in construction and lends itself to economical manufacture.

Other objects and advantages of the invention will become apparent upon reading the following detailed description and upon reference to the drawings, in which.

Figure 1:
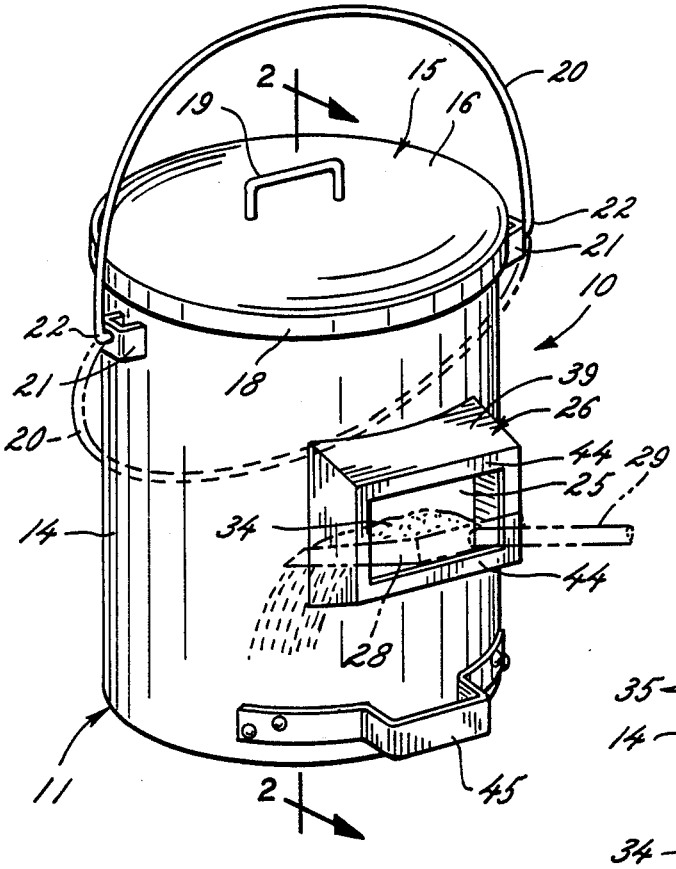
FIG. 1 is a perspective of an illustrative dustless ash container embodying the present invention.

While the invention is susceptible of various modifications and alternative constructions, a certain illustrated embodiment thereof has been shown in the drawings and will be described below in detail. It should be understood, however, that there is no intention to limit the invention to the specific form disclosed, but on the contrary, the intention is to cover all modifications, alternative constructions and equivalents falling within the spirit and scope of the invention.

Referring now more particularly to FIG. 1 of the drawings, there is shown an illustrative ash container 10 embodying the present invention. The ash container 10 includes a receptacle 11 comprising a flat bottom wall 12 and a generally cylindrical upstanding side wall 14, preferably made of metal, such as copper or galvanized steel. The cylindrical side wall 14 defines a top opening for the receptacle 11 which may be closed by a removeable cover 15. The cover 15 in this instance has a substantially flat top wall 16, corresponding in shape to the top of the receptacle 11, with a peripheral flange 18 extending downwardly from the top wall 16. When the cover 15 is in mounted position on the receptacle 11, the flange 18 fits snugly about the upper periphery of the receptacle side wall 14 so as to prevent the escape of dust from the top of the receptacle. The cover 15 has a generally C-shaped handle 19 mounted in upstanding relation centrally thereon for use in lifting the cover 15 upwardly from the receptacle 11 when the receptacle is to be opened for the purpose of dumping ashes contained therein.

To enable lifting and transport of the container 10, the receptacle 11 has a handle 20 pivotally supported at its opposite ends by respective brackets 21 mounted in outwardly extending fashion from opposed sides of the side wall 14 near the top thereof. The handle 20 is in the form of a generally U-shaped metal rod having end portions 22 bent inwardly so as to form diametrically opposite pivots received by the brackets 21. The handle 20 is swingable between an erect position, such as shown in FIG. 1, and a lowered position, such as shown in phantom in FIG. 1.

In accordance with the invention, the container has an ash entrance opening in the side of the receptacle formed by an outwardly extending collar located intermediate the top and bottom of the receptacle so as to define within the receptacle an ash accumulation zone below the entrance opening and a dust reflection and redirection zone above the entrance opening. To this end, the illustrated receptacle 11 has a side entrance opening 25 located approximately midway between the top and bottom of the receptacle, defined by an open ended collar 26 mounted in outwardly extending relation to the side wall 14 of the receptacle. The opening 25 in this case is rectangular configured and is sized for receiving the scoop end 28 of a fireplace shovel 29, (FIG. 1). In practice, an entrance opening of six inches by six inches has been found to provide adequate access to the receptacle 11.

Figure 2:
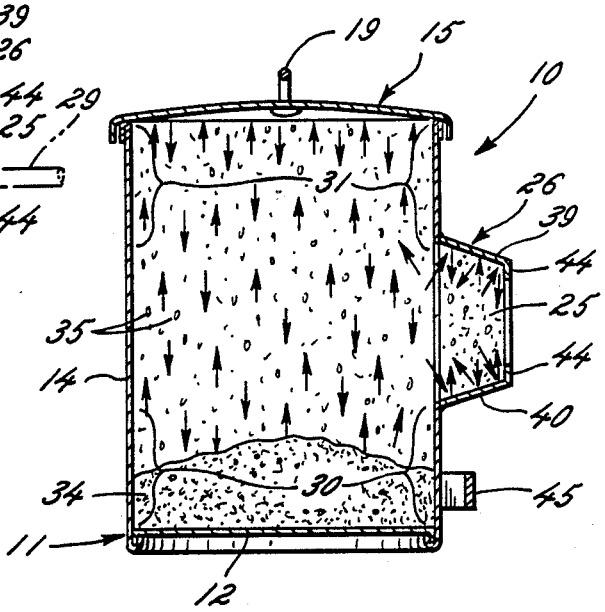
FIG. 2 is a vertical section of the ash container shown in FIG. 1 taken in the plane of line 2—2, and diagrammatically illustrating the movement of airborne ash dust within the container.

With the container lid 15 positioned on the receptacle 11, the receptacle 11 defines an ash accumulation zone 30 below the opening 25 and an ash reflection and redirection zone 31 above the opening 25 (FIG. 2). More particularly, the ash accumulation zone 30 is defined by the bottom wall 12 of the receptacle and a portion of the cylindrical side wall 14, with the upper end of the ash accumulation zone 30 communicating with the dust reflection and redirection zone 31. The dust reflection and redirection zone 31 is defined by the lid 15 and an upper portion of the receptacle side wall 14, with the lower end of the dust reflection and redirection zone 31 communicating with the accumulation zone 30. The ash accumulation zone 30 preferably should be at least one-third of the height of the receptacle 11, and the dust reflection and redirection zone 31 also preferably should be at least one-third of the height of the receptacle. In the illustrated embodiment, the entrance collar 26 is disposed slightly above the midpoint of the side wall 14.

When ash 34 is directed through the opening 25 into the container 10, such as by means of the ash shovel 29 (FIG. 1), it will be seen that the ash 34 will fall by gravity into the ash accumulation zone 30 below the entrance opening 25. Because of the lightness of weight of the ash, dust particles 35 from the ash will become airborne and rise into the reflection and redirection zone 31 in the top of the receptacle 11. Most of the dust particles 35 will rise into contact with the substantially flat cover 15 that defines the top of the reflection and redirection zone 31, which causes the dust particles 35 to lose momentum and to be reflected in a generally downward direction for return into the accumulation zone 30. Such action of the airborne dust particles 35 ultimately will cause the particles to settle in the accumulation zone. Since the reactionary forces acting on the dust particles 35 are largely vertical, most of the dust particles 35 will settle into the accumulation zone 30 without straying out the side opening 25 between the accumulation and reflection zones 30, 31.

In keeping with the invention, the side opening entrance collar 26 is adapted for impeding the escape of airborne dust particles 35 within the receptacle 11 into the room environment and for redirecting such dust particles back into the receptacle. For this purpose, the entrance collar 26 has an outwardly and downwardly tapered upper wall 39 and an outwardly and upwardly tapered bottom wall 40, both of which preferably extend about three inches outwardly from the side wall 14 of the receptacle 11. At the outset, the entrance collar 26 serves to catch ash 34 which drops from the shovel when being directed through the entrance opening 25. Moreover, ash 34 dropped onto the bottom wall 40 of the collar 26 will tend to be directed into the receptacle 11 by virtue of the downward inclination of the bottom wall 40. Ash particles 35 which becomes airborne, either within the collar 26 or within the receptacle 11 and then enter the collar 26, generally will rise until they strike the upper wall 39 of collar 26. Reflection off the upper collar wall 39 will reduce the momentum of particle movement and by virtue of the inclination of the upper wall 39, the particles will tend to be redirected in a downward direction toward the oppositely tapered bottom wall 40, as illustrated in FIG. 2. Continual reflection off the oppositely inclined top and bottom collar walls 39, 40 tends to redirect the airborne dust particles in an inward direction into the receptacle 11. To further impede the escape of airborne dust particles from the collar 26, the collar 26 terminates in a vertical lip 44 about its outer perimeter, which may be on the order of one inch and which defines the actual entrance opening 25 to the container.

Figure 3:
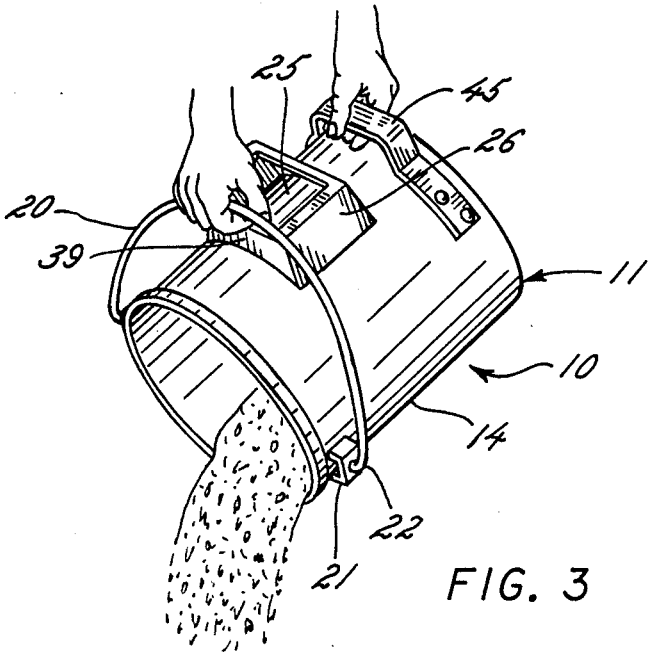
FIG. 3 depicts manual dumping of the contents of the container with the cover thereof removed.

When the accumulation zone 30 of the receptacle 11 is filled with ash 34, or it is otherwise desired to empty the contents of container 10, the container 10 may be lifted by the handle 20 and carried to a dumping site where the cover 15 may be removed. To facilitate dumping of the container 10, a second handle 45 is provided on the side wall 14 of the receptacle 11 adjacent the lower end thereof immediately below the entrance collar 26. The handle 45 in this case is a C-shaped strap welded at its opposed ends to the receptacle side wall 14. Since the handle 45 is located below the collar 26, by holding the container handle 20 in one hand and grasping the lower receptacle handle 45 in the other, the receptacle 11 may be tipped about the pivot connection of the upper handle 20 by a lifting force on the handle 45, as shown in FIG. 3. Ashes contained within the accumulation zone 30 are directed along the cylindrical portion of the side wall 14 opposite the entrance opening 25. Following dumping, the cover 15 is replaceable on the receptacle 11, and the container 10 may be stored adjacent the fireplace or woodburning stove until the need for further use arises. The simplicity of the container 10 allows it to blend esthetically with the surroundings of a home environment.

From the foregoing, it can be seen that the ash container of the present invention is adapted for easy and substantially dust-free containment of ash from fireplaces and woodburning stoves. The container permits unencumbered access to the ash-receiving receptacle while substantially preventing the escape of airborne dust generated when depositing ash into the container through the entrance opening. The container is free of cumbersome swinging or closeable doors, typical of the prior art, which must be manipulated when depositing ash into the container, and the simplicity of the construction lends itself to economical manufacture.

I claim as my invention:

1. An ash container comprising a receptacle having a bottom wall and a side wall defining an open top, a removeable cover for closing the open top of said receptacle, a collar extending outwardly from one side of said side wall intermediate said bottom wall and the top of said receptacle defining a side entrance opening to said receptacle, said side wall having a lower uninterrupted portion below said entrance opening and a upper uninterrupted portion above said entrance opening, said bottom wall and said lower uninterrupted portion of said side wall defining an ash accumulation zone below said entrance opening for containing ash deposited into said receptacle through said entrance opening, and said cover and said upper uninterrupted portion of said side wall defining a dust reflection and redirection zone above said entrance opening for confining and redirecting downwardly into said accumulation zone dust from ash deposited into said receptacle through said entrance opening.

2. The ash container of claim 1 in which said ash accumulation zone extends upwardly from said bottom wall at least one-third the height of said receptacle.

3. The ash container of claim 2 in which said dust reflection and redirection zone extends downwardly from the top of said receptacle at least one-third the height of said receptacle.

4. The ash container of claim 3 in which said collar extends outwardly of said side wall about three inches.

5. The ash container of claim 3 in which said collar has a top wall which extends outwardly of said receptacle side wall in downwardly inclined relation to the horizontal.

6. The ash container of claim 5 in which said collar has a bottom wall extending outwardly of said side wall in upwardly inclined relation to the horizontal.

7. The ash container of claim 6 in which said collar has an outermost end terminating in a vertical lip which defines said entrance opening.

8. The ash container of claim 1 including an upper handle pivotably connected to said receptacle for lifting and transporting said container.

9. The ash container of claim 8 in which said upper handle is C-shaped with opposite ends pivotably connected to opposite sides of said side wall adjacent the top thereof.

10. The ash container of claim 8 including a second handle connected to said side wall immediately below said collar for facilitating lifting of a lower end of said receptacle to dump ashes contained therein out the top of said receptacle when said cover is removed with the ashes being directed along a portion of said side wall opposite said entrance opening.

11. The ash container of claim 1 in which said collar defines a continuously unobstructed entrance opening.

12. The ash container of claim 11 in which said entrance opening is sized for receiving the scoop of an ash shovel.

13. The ash container of claim 12 in which said entrance opening is rectangular in configuration.

14. The ash container of claim 1 in which said cover has a substantially flat top wall and a depending lip about the periphery thereof for positioning about the top of said receptacle side wall.

15. The ash container of claim 1 in which said collar has a top wall which extends outwardly of said receptacle side wall in downwardly inclined relation to the horizontal and a bottom wall extending outwardly of said side wall in upwardly inclined relation to the horizontal.

16. The ash container of claim 15 including an upper handle pivotably connected to said receptacle for lifting and transporting said container, and a lower handle connected to said side wall immediately below said collar for facilitating lifting of a lower end of said receptacle to dump ashes contained therein out the top of said receptacle when said cover is removed with the ashes being directed along a portion of said side wall opposite said entrance opening.

17. The ash container of claim 16 in which said ash accumulation zone extends upwardly from said bottom wall at least one third of the height of said receptacle, and said reflection and redirection zone extends downwardly from the top of said receptacle at least one third of the height of said receptacle.

18. The ash container of claim 17 in which said collar extends outwardly of said sidewall about three inches and terminates in a vertical lip that defines said entrance opening.

* * * * *